US012583657B2

(12) United States Patent
Faeht et al.

(10) Patent No.: US 12,583,657 B2
(45) Date of Patent: Mar. 24, 2026

(54) TOOL ACCESSORY PACKAGING AND TOOL ACCESSORY PRODUCT

(71) Applicant: Robert Bosch GmbH, Stuttgart (DE)

(72) Inventors: Alexander Faeht, Solothurn (CH); Florian Beck, Nuremberg (DE); Pedro Costa, Zuchwil (CH); Thomas Reissig, Feuchtwangen (DE); Tim Hoffmann, Nuremberg (DE); Simon Johansson, Johanneshov (SE)

(73) Assignee: Robert Bosch GmbH, Stuttgart (DE)

( * ) Notice: Subject to any disclaimer, the term of this patent is extended or adjusted under 35 U.S.C. 154(b) by 13 days.

(21) Appl. No.: 18/535,793

(22) Filed: Dec. 11, 2023

(65) Prior Publication Data

US 2024/0190633 A1 Jun. 13, 2024

(30) Foreign Application Priority Data

Dec. 13, 2022 (DE) ..... 10 2022 213 560.1

(51) Int. Cl.
*B65D 75/20* (2006.01)
*B65D 85/20* (2006.01)

(52) U.S. Cl.
CPC ..... *B65D 75/20* (2013.01); *B65D 85/20* (2013.01)

(58) Field of Classification Search
CPC ..... B65D 5/0005; B65D 5/02; B65D 5/0227; B65D 5/28; B65D 5/32; B65D 5/42; B65D 5/50; B65D 5/54; B65D 75/20; B65D 75/32; B65D 75/36; B65D 85/20
USPC ..... 206/349, 363–383
See application file for complete search history.

(56) References Cited

U.S. PATENT DOCUMENTS 2,202,879 A 6/1940 Wentz
2,936,940 A * 5/1960 Berghgracht ..... B65D 75/22 383/122
3,944,131 A 3/1976 Weiss
4,261,506 A * 4/1981 Scott ..... B65D 33/14 206/806
4,770,338 A * 9/1988 Tatusch ..... B65D 5/42 229/102
5,064,114 A * 11/1991 Cravens ..... B65D 5/0005 206/424
5,605,278 A * 2/1997 Jensen ..... B65D 5/4208 206/806

(Continued)

FOREIGN PATENT DOCUMENTS

DE 92 17 287 U1 3/1993
DE 199 57 310 A1 6/2001

(Continued)

*Primary Examiner* — Bryon P Gehman
(74) *Attorney, Agent, or Firm* — Maginot, Moore & Beck LLP

(57) ABSTRACT

A tool accessory packaging for at least one tool accessory, in particular a drill bit, includes a packaging base body which forms a receiving pocket, in particular a folded pocket, for receiving the at least one tool accessory and which is intended for receiving tool accessories with different geometries in the receiving pocket. The receiving pocket adapts to a geometry of the at least one tool accessory, at least in sections, due to its material-specific restoring force when the at least one tool accessory is arranged in the receiving pocket and fixes the at least one tool accessory in a receiving region, in particular in a non-slip manner.

16 Claims, 2 Drawing Sheets

(56) References Cited

U.S. PATENT DOCUMENTS

| | | | | |
|---|---|---|---|---|
| 6,227,359 | B1 * | 5/2001 | Truluck | B65D 75/26 206/207 |
| 6,328,160 | B1 * | 12/2001 | Cooksey | B65D 5/0227 206/312 |
| 8,309,896 | B2 * | 11/2012 | Fitzwater | B65D 5/54 229/101.1 |

FOREIGN PATENT DOCUMENTS

| | | | |
|---|---|---|---|
| DE | 10 2013 017 140 | A1 | 4/2015 |
| EP | 3 736 221 | A1 | 11/2020 |
| GB | 2 370 831 | A | 7/2002 |

* cited by examiner

TOOL ACCESSORY PACKAGING AND TOOL ACCESSORY PRODUCT

This application claims priority under 35 U.S.C. § 119 to application no. DE 10 2022 213 560.1, filed on Dec. 13, 2022 in Germany, the disclosure of which is incorporated herein by reference in its entirety.

BACKGROUND

Tool accessory packaging having a packaging body and a receiving pocket is generally known from the prior art.

SUMMARY

The disclosure is based on a tool accessory packaging for at least one tool accessory, in particular a drill bit, with a packaging base body which forms a receiving pocket, in particular a folded pocket, for receiving the tool accessory and which is intended for receiving tool accessories with different geometries in the receiving pocket.

It is proposed that the receiving pocket adapts to a geometry of the tool accessory at least in sections due to its material-specific restoring force when the tool accessory is arranged in the receiving pocket and fixes the tool accessory in a receiving region, in particular in a non-slip manner.

The embodiment according to the disclosure can provide a particularly flexible, user-friendly and convenient tool accessory packaging. In addition, stability can be improved for fixing a tool accessory in the tool accessory packaging. In addition, efficiency can be increased in terms of product, labor, cost, manufacturing, packaging and/or recycling efficiency.

Preferably, the tool accessory packaging is part of a tool accessory product. The tool accessory product may comprise the tool accessory and at least the tool accessory packaging. Preferably, the tool accessory product is a drill bit product. Alternatively and/or additionally, the tool accessory product could, for example, be a hammer product, a screw product, a screwdriver product, a grinding tool product, a saw product or the like. Advantageously, the tool accessory product is a hand tool accessory product. The tool accessory product can be any product that appears useful to the person skilled in the art. In particular, the tool accessory packaging is intended for packaging at least the tool accessories. Furthermore, the tool accessory packaging can be a packaging for a hammer accessory, a screw, a screwdriver accessory, a grinding tool accessory, a saw accessory or the like. Advantageously, it is a hand tool accessory. The tool accessory can be any tool accessory that appears useful to the person skilled in the art.

The packaging base body can have any labels, inscriptions, markings, securing elements for hanging and/or fixing, protective elements, viewing elements or the like. In particular, the packaging base body forms the receiving pocket in at least one packaging state. Preferably, the receiving pocket is designed as a folded pocket. In the application state, the packaging base body can be folded at least in sections to form the folded pocket. One and the same packaging base body can receive tool accessories with different geometries. The receiving pocket can be adapted to the tool accessories with different geometries. Due to the material-specific flexibility, the receiving pocket can adapt to the geometry of the tool accessory. The receiving pocket has the receiving region in which the tool accessories can be arranged. Preferably, the receiving pocket is closed on at least two sides, advantageously on at least three sides. In at least one application state, the receiving pocket can be open at least in sections on at least one side. The application state can be a filling and/or removal state. When filling and/or arranging the tool accessory in the receiving space, at least one side of the receiving pocket, preferably a head side of the receiving pocket, can be open at least in sections in order to push and/or press and/or insert the tool accessory into the receiving space. In particular, the receiving pocket can be filled with the tool accessories in the filling state. Furthermore, when removing and/or removing the tool accessory from the receiving pocket, at least one side of the receiving pocket, for example the head side of the receiving pocket and/or preferably a bottom side of the receiving pocket, can be open at least in sections in order to push and/or push out and/or pull out the tool accessory from the receiving space. In particular, the tool accessories can be removed from the receiving pocket in the removal state.

The receiving pocket can secure and/or fix the tool accessory in the receiving region, preferably without slipping, by means of the material-specific restoring force and the material-specific flexibility. The tension resulting from the material-specific restoring force can fix the tool accessory in the receiving region. Preferably, the packaging base body makes direct contact with the tool accessory arranged in the receiving region. Alternatively, it would also be conceivable for the packaging base body to make indirect contact with the tool accessories arranged in the receiving region. Further elements and/or units, such as padding elements, spacer elements or the like, could be arranged between the packaging base body and the tool accessory product. When manufacturing the tool accessory product, the tool accessory can be arranged in the receiving pocket in a filling step, for example inserted, pushed and/or pressed into the receiving pocket. In particular, the receiving pocket is in the filling state in the filling step. By means of the material-specific restoring force, an expansion and/or pocket opening adapts to the geometry of the tool accessory. Preferably, a pocket diameter of the receiving pocket adapts to the geometry of the tool accessory, namely to at least one diameter of the tool accessory. Furthermore, the receiving pocket, at least the pocket diameter, could adapt to a shape, for example a round or angular or pointed shape of the tool accessory arranged in the receiving region.

In this document, "intended" is understood to mean specially programmed, set up, designed and/or equipped. When an object is intended for a particular function, this is to be understood as meaning that the object fulfills and/or performs that particular function in at least one application and/or operating state.

It is further proposed that the tool accessory packaging has at least one group of fold lines comprising at least two, in particular at least three, fold lines which run at least in sections at least essentially parallel to one another. This can further improve a design and reduce the material-specific bending force of a packaging base body in certain regions by means of fold lines. This enables simple, easy and convenient bending and/or forming of the packaging base body.

In particular, the fold lines are crease lines, crease cut lines and/or weakening lines. In particular, the fold lines are intended for folding and/or bending and/or creasing the packaging base body. The fold lines of the group of fold lines can run straight at least in sections or be curved at least in sections. Preferably, all fold lines of the group of fold lines run at least in sections at least essentially parallel to each other. In a preferably flat state, namely an unbent and/or unfolded state of the packaging base body, the fold lines of the group of fold lines can run at least essentially parallel to a longitudinal edge of the packaging base body. In a folded and/or bent state of the packaging base body, at least one fold line of the group of fold lines can form an outer longitudinal edge of the packaging base body. When manufacturing the tool accessory packaging, the packaging base body is formed, preferably folded, in a shaping step to form the receiving pocket. In particular, in the shaping step, the packaging base body is folded and/or creased along at least one fold line of the group of fold lines and preferably along all fold lines of the group of fold lines.

A distance between the fold lines of the group of fold lines may depend on a size and/or shape of the packaging base body and/or a size and/or shape of the tool accessory to be received in the receiving pocket. Preferably, two adjacent/arranged fold lines of the group of fold lines always have an at least essentially identical distance to one another. In this context, "at least essentially" should be understood to mean that a deviation from a predetermined value and/or orientation is less than 25%, preferably less than 10% and particularly preferably less than 5% of the predetermined value and/or orientation. Preferably, a first distance between a first fold line of the group of fold lines and at least a second fold line of the group of fold lines is at least essentially identical to a second distance between the second fold line and at least a third fold line of the group of fold lines, within the range of standardized tolerances.

In the present case, "essentially parallel" is to be understood as an alignment of a direction relative to a reference direction, in particular in a plane, wherein the direction has a deviation of less than 8° from the reference direction, advantageously less than 5° and particularly advantageously less than 2°. Furthermore, in the present document, numerical words, such as "first" and "second", which precede certain terms, are only used to differentiate between method steps and/or objects and/or to assign objects to one another and do not imply an existing total number and/or ranking of the objects and/or method steps. In particular, a "second" object and/or method step does not necessarily imply the presence of a "first" object and/or method step.

The fold lines of the group of fold lines can run at least essentially parallel to one another in at least one central region of the packaging base body. The central region can be located between an upper region and a lower region of the packaging base body. Viewed in the main direction of extension of the packaging base body, advantageously in the longitudinal direction of the packaging base body, the central region can extend over at least 30%, advantageously at least 50% and preferably at least 70% of an overall extension of the packaging base body. Viewed in the longitudinal direction of the packaging base body, the lower region could extend over at least 5%, advantageously at least 10% and preferably at least 15%, of the overall extension of the packaging base body. Furthermore, viewed in the longitudinal direction, the upper region can extend over at least 5%, advantageously at least 10% and preferably at least 15% of the overall extension of the packaging base body. In particular, the upper region and the lower region extend in equal parts along the longitudinal direction of the packaging base body.

The fold lines can be inserted into the packaging base body during production. At least one of the fold lines of the group of fold lines, preferably all fold lines of the group of fold lines, can be pressed, embossed and/or scored into the material of the packaging base body. Preferably, the fold lines are embossed into the packaging base body in at least one embossing step during production of the packaging base body. However, it is also conceivable that the fold lines are perforation lines.

In order to further improve a construction and to reduce a material-specific bending force of a packaging base body in certain regions and thus to be able to provide simple, easy and convenient bending and/or forming of the packaging base body, it is proposed that the tool accessory packaging has at least one further group of further fold lines comprising at least two, in particular at least three, further fold lines which run at least in sections at least essentially parallel to one another and at least in sections at least essentially parallel to the fold lines of the group of fold lines.

Preferably, the additional fold lines are creasing lines, creasing cut lines and/or weakening lines. The other fold lines can be inserted into the material of the packaging base body in the same way as the fold lines of the group of fold lines. Preferably, the further fold lines are embossed into the packaging base body in at least the embossing step and/or at least one further embossing step during production of the packaging base body. The further fold lines of the further group of further fold lines can run straight at least in sections or be curved at least in sections. Preferably, all further fold lines of the further group of further fold lines run at least in sections at least essentially parallel to each other and to the fold lines of the group of fold lines. The further fold lines of the further group of further fold lines can run at least essentially parallel to one another in at least the central region of the packaging base body.

The group of fold lines and the further group of additional fold lines can be arranged at opposite ends of the packaging base body. In the preferably flat state, namely the unbent and/or unfolded state of the packaging base body, the further fold lines of the further group of further fold lines can run at least essentially parallel to the longitudinal edge of the packaging base body. In the folded and/or bent state of the packaging base body, at least one further fold line of the further group of further fold lines can form a further outer longitudinal edge of the packaging base body. Preferably, the outer longitudinal edge of the packaging base body in the folded and/or bent state of the packaging base body runs at least in sections at least essentially parallel to the further outer longitudinal edge.

Preferably, two adjacent/arranged further fold lines of the further group of further fold lines always have an at least essentially identical distance to one another. A first further distance between a first further fold line of the further group of further fold lines and at least one second further fold line of the further group of further fold lines is at least essentially identical to a second further distance between the second further fold line and at least one third further fold line of the further group of further fold lines, namely in the range of standardized tolerances. When producing the tool accessory packaging, the packaging base body is folded and/or creased in the in sections step along at least one further fold line of the further group of further fold lines and preferably along all further fold lines of the further group of further fold lines.

In addition, it is proposed that the receiving region extends between the group of fold lines and the further group of further fold lines and that the tool accessory can be fixed at least essentially centrally in the receiving space between the group of fold lines and the further group of further fold lines. This allows a stable tool accessory packaging to be provided and at least one tool accessory to be stably and/or firmly fixed and/or secured in the center of a receiving space.

In particular, the receiving region extends between the group of fold lines and at least the further group of further fold lines. The receiving region can extend into the central region. Preferably, the receiving region also extends from the lower region via the central region to the upper region. At least a part and/or a section of the tool accessory could be arranged in the upper region and/or the lower region and/or arranged in the packaging state. Based on the material-specific restoring force, the packaging base body can press against the tool accessory product arranged centrally in the receiving space between the group of fold lines and the further group of further fold lines and fix and/or secure it there.

It is further proposed that at least the fold lines of the group of fold lines converge to a point in at least one region of the packaging base body that is different from an end region of the packaging base body. This makes it possible to optimize the fixing of a tool accessory in a receiving region of a packaging base body, which in turn improves the design.

Preferably, the fold lines of the group of fold lines converge to a point in the upper region and/or the lower region. The respective ends of the fold lines of the group of fold lines can meet at a common point in the upper region and/or the lower region and converge there. Furthermore, the further fold lines of the further group of further fold lines can converge to a point in at least one region of the packaging base body that is different from the end region. Preferably, the further fold lines of the further group of further fold lines converge to a point in the upper region and/or the lower region. The respective ends of the further fold lines of the further group of further fold lines can meet at a common point in the upper region and/or the lower region and converge there. The upper region and/or the lower region could each have an additional fold line. In each case, the fold lines of the group of fold lines and/or the further fold lines of the further group of further fold lines can converge at an angle to the additional fold line in the upper region and/or the lower region.

Furthermore, it is proposed that the packaging base body has at least one perforated region for releasing the tool accessory. This makes it easy, user-friendly and convenient to remove a tool accessory from a tool accessory pack, which in turn increases user convenience.

Preferably, at least one perforation line is arranged in the perforated region. The additional fold line in the lower region could be the perforation line. To remove and/or remove the tool accessory from the receiving pocket, a user in the lower region could tear open the packaging base body at least in sections or completely at the perforation line. In the removal state for releasing the tool accessory, at least the lower region can be separated from the central region, at least in sections. In particular, the perforated region is an intermediate region, namely a separating region between the central region and the lower region.

If the packaging base body is designed in one piece, in particular integrally, a design can be further improved and efficiency can be increased in terms of product, manufacturing, labor, recycling, material and/or cost efficiency. The term "in one piece" should be understood to mean at least a materially bonded connection, for example by an adhesive process, an injection molding process and/or welding process and/or another process that appears to the person skilled in the art to be reasonable. Furthermore, "in one piece" should be understood to mean formed in one piece. Preferably, this one piece is produced from a single blank, a mass and/or a casting, particularly preferably in an injection molding process, in particular a single and/or multi-component injection molding process, and/or in a stamping process and/or in a sheet metal bending process and/or in a printing process, for example a 3D printing process, and/or by means of thermoforming and/or another process which appears to the person skilled in the art to be useful from the single blank.

It is also proposed that the packaging base body is designed from a flat blank. This can further increase efficiency in terms of at least one of manufacturing, cost, material, manufacturing effort and/or product efficiency. The flat blank could be stored and/or transported on a roll and unwound from the roll when the packaging base body is produced. Along a production line, the flat blank could be machined and/or shaped and/or cut in a manufacturing method to produce the tool accessory packaging. In particular, the fold lines and/or the additional fold lines can be incorporated into the flat blank.

The packaging base body could consist at least partially and/or at least to a large extent of a mineral and/or a metal and/or a plastic and/or a composite material. The expression "to a large extent" should be understood here to mean, for example, at least 55%, advantageously at least 65%, preferably at least 75%, particularly preferably at least 85% and particularly advantageously at most 95% of a surface area and/or volume and/or mass fraction.

In order to provide a sustainable, resource-saving and/or recyclable tool accessory packaging, it is proposed that the packaging base body is made at least to a large extent from renewable raw materials. In this context, "renewable raw materials" should be understood to mean organic raw materials, in particular plant-based raw materials, which originate from agricultural and/or forestry production and are cultivated by humans specifically for further application purposes outside the food and animal feed industry or which are by-products and/or waste products from agriculture and/or the food and animal feed industry. Renewable raw materials within the meaning of the present application are exclusively organic raw materials which are not of fossil origin. Preferably, renewable raw materials are domestic products from agricultural and/or forestry production as well as their by-products and/or residues, provided they are not subject to waste legislation, as well as algae. Preferably, the packaging base is made entirely from renewable raw materials. In particular, the packaging base body is free of plastic and/or metal.

It is also proposed that at least a large part of the packaging base body is made of a fiber-based material. This can provide particularly sustainable, resource-saving and/or recyclable tool accessory packaging and increase efficiency in terms of at least one of product, recycling and/or cost efficiency. Furthermore, material costs can be reduced, the tool accessory packaging can be manufactured at a favorably low cost and the manufacturing process is preferably simple. In addition, the tool accessory packaging can be given an advantageous high level of stability.

The packaging base body could consist at least to a large extent or preferably completely of a cellulose material, for example paper, advantageously waste paper, and in particular a renewable cellulose material, for example hay and/or straw and/or hemp and/or groundwood pulp and/or another cellulose material which appears to the person skilled in the art to be useful. Preferably, at least a large part of the packaging base is made of paper, and particularly preferably all of it is made of cardboard. The packaging base body can be made of paper or cardboard with a grammage of at least 120 $g/m^2$, preferably at least 200 $g/m^2$, particularly preferably at least 300 $g/m^2$ and preferably at least 500 $g/m^2$.

The packaging base could be at least partially or completely water-resistant, grease-repellent and/or fireproof.

Preferably, the packaging base body has a high degree of robustness and/or dimensional stability and/or shock absorption. The packaging base body could have a smooth and/or flat outer surface and/or inner surface, at least in sections. Advantageously, the surface, namely the outer surface and/or inner surface, is rough at least in sections.

The method for manufacturing the tool accessory packaging can comprise several method steps. In particular, in at least one first method step in the production of the tool accessory packaging, the flat blank is produced, advantageously from a fiber casting, for example from paper fibers dissolved in water, in particular waste paper fibers, and/or hay and/or straw and/or hemp, in at least one vacuum, pressing and/or drying process, in particular brought into a desired shape. In the first method step, several layers of paper are preferably placed on top of each other and joined together to produce cardboard. In a second method step, which takes place after the first method step, in particular with regard to the timing of the manufacturing process, the flat blank can be cut and/or punched to form the packaging base body. Furthermore, in a third method step following the second method step, at least one fold line of the group of fold lines can be introduced into the packaging base body, for example punched, embossed and/or scored. Advantageously, all fold lines of the group of fold lines are introduced, preferably embossed, into the packaging base body in the third method step. Preferably, in the third method step, the further fold lines of the further group of further fold lines are also introduced, in particular embossed, into the packaging base body. Furthermore, additional fold lines can be introduced into the packaging base body in the third method step. It would also be conceivable for the perforation line to be inserted into the packaging base body in the perforated region during the method step.

In a fourth method step, in particular in a shaping step, the packaging base body can be shaped, preferably folded along at least one fold line of the group of fold lines and/or at least one further fold line of the group of further fold lines. Preferably, the packaging base body is folded in such a way that its longitudinal sides meet on a rear side of the packaging base body. In a fifth method step, longitudinal sides of the packaging base body could be joined together, preferably welded and/or glued. Preferably, the fifth method step takes place after the fourth method step with regard to the timing of the manufacturing process. In particular, the longitudinal sides of the packaging base body can be connected to each other, preferably by means of a material bond, such as by gluing, welding and/or fusing. The fifth method step can be a longitudinal sealing step, in which a longitudinal seal is made and the longitudinal sides of the packaging base body are joined together by means of a longitudinal sealing seam. The packaging base can also have the longitudinal sealing seam on the back.

In a sixth method step, which can follow the fifth method step, the packaging base body can be sealed in at least one end region, preferably in at least one head or base end region. Advantageously, the base end region of the packaging base body is sealed with a material bond, for example by gluing, welding and/or fusing. The sixth method step can be a cross-sealing step. Preferably, in the sixth method step, a cross-sealing is made in the base end region of the packaging base body.

Subsequently, in a seventh method step, the receiving pocket can be filled and/or filled with at least the tool accessory. In order to facilitate access to the receiving space, the packaging base body can be deformed at least in sections. In the seventh method step, the tool accessory can be arranged and/or positioned within the receiving pocket in the receiving region, wherein the tool accessory is fixed in the receiving pocket by means of the material-specific restoring force. After successful filling, in an eighth methods step, the packaging base body can be closed in the head end region, in particular with a material bond, for example by gluing, welding and/or fusing. The eighth method step could be a further cross-sealing step. Preferably, in the eighth method step, a cross-sealing is made in the head end region of the packaging base body.

Preferably, the packaging base body is sealed at its opposite end regions, namely in a head and base end region, in particular the aforementioned head and base end region. This makes it possible to provide particularly stable tool accessory packaging for at least one tool accessory. In addition, efficiency can be further increased in terms of manufacturing efficiency. Advantageously, the base end region is located in front of the bottom region when viewed in the longitudinal direction of the packaging base body. The base end region can be directly connected to the lower region. In particular, the lower region separates the base end region from the central region. Furthermore, the head end region can be located behind the upper region when viewed in the longitudinal direction of the packaging base body. The head end region can be directly adjacent to the upper region. In particular, the upper region separates the head end region from the central region. Preferably, the central region is arranged directly next to the upper region and the lower region.

It is conceivable that in the first method step and/or the second method step, at least one region of the flat blank can be coated, at least in sections. If the packaging base body is made of a sealable material and has a sealing lacquer in at least one region, in particular at least one end region, then manufacturing efficiency can be increased and manufacturing costs can be effectively reduced. Thus, in addition to heat sealing, ultrasonic sealing can be enabled and/or provided for sealing the packaging base body. The sealing lacquer can be applied at least in sections, namely partially in at least the end region, preferably in the head and/or base end region, of the packaging base body. The sealing lacquer is advantageously a sealing lacquer known to the person skilled in the art, which seals elements or materials together by heat sealing or ultrasonic sealing.

Preferably, the tool accessory packaging has a retaining element in the head end region for suspension and/or attachment to external elements and/or units. The retaining element can be a Eurohole known to the person skilled in the art. In particular, a Euro hole is punched into the base body of the packaging in the head end region.

The tool accessory packaging according to the disclosure and the tool accessory product according to the disclosure should not be limited to the application and embodiment described above. In particular, the tool accessory packaging and/or the tool accessory product may have a number of individual elements, components and/or units other than a number specified herein in order to fulfill a function described herein. Moreover, regarding the ranges of values indicated in this disclosure, values lying within the aforementioned limits are also intended to be considered as disclosed and usable as desired.

BRIEF DESCRIPTION OF THE DRAWINGS

Further advantages follow from the description of the following drawings. The drawing shows an exemplary embodiment of the disclosure. The drawing, the description, and the claims contain numerous features in combination. The person skilled in the art will appropriately also consider the features individually and combine them into additional advantageous combinations.

The figures show.

DETAILED DESCRIPTION

The figures are schematic representations and not to scale.

Figure 1:
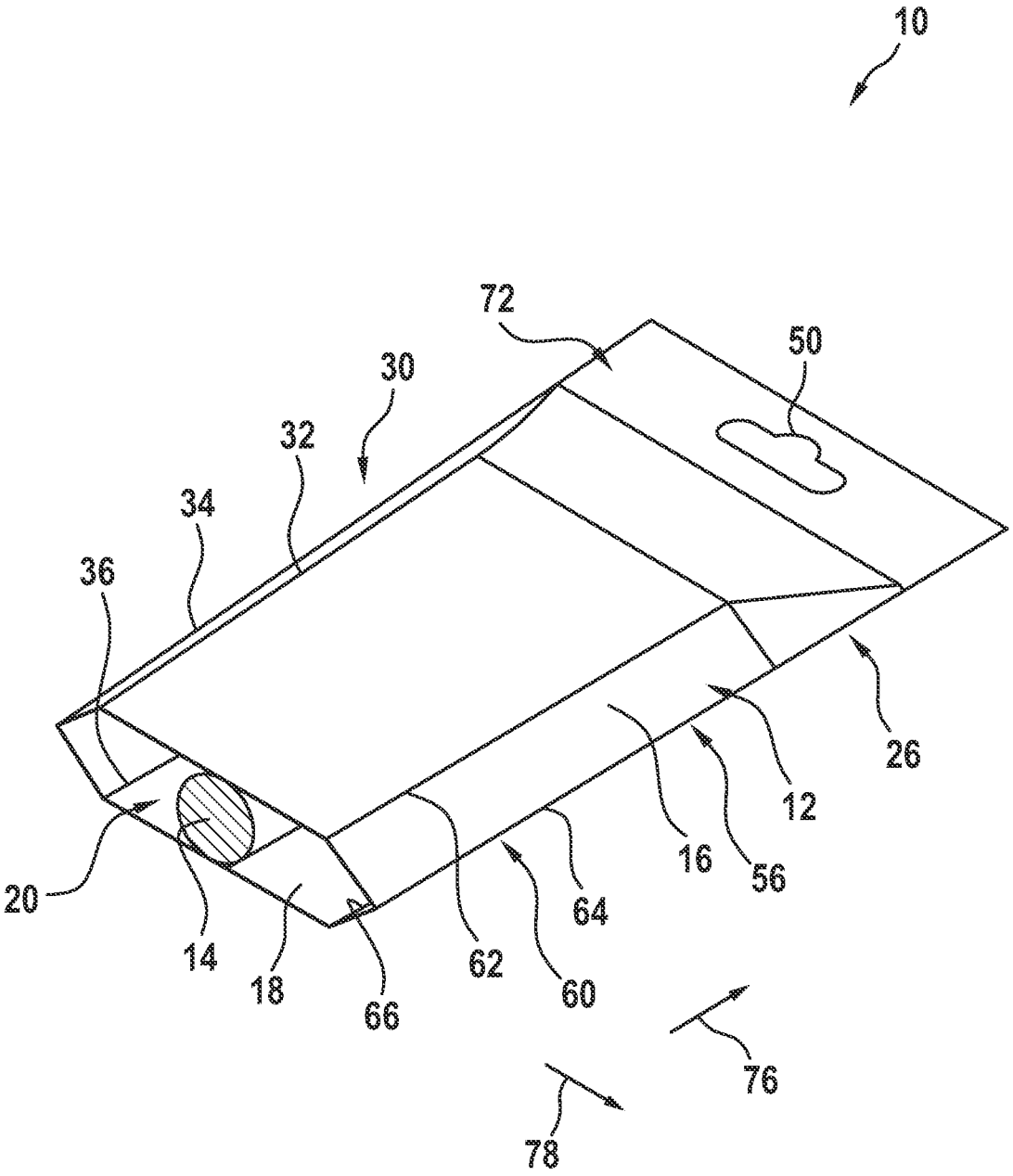
FIG. 1 a tool accessory product with a tool accessory packaging and a tool accessory arranged in a receiving pocket of a packaging base body of the tool accessory packaging in a sectional view, FIG. 2 the packaging base body formed from a flat material before shaping to form the receiving pocket, and FIG. 3 a plurality of tool accessory packagings which are identical to each other and whose receiving pockets adapt to different geometries of tool accessories.

FIG. 1 shows a sectional view of a tool accessory product 10. In the present case, the tool accessory product 10 is designed as a hand tool product, specifically as a drill bit product. Alternatively and/or additionally, the tool accessory product 10 could, for example, be a hammer product, a screw product, a screwdriver product, a grinding tool product, a saw product or the like. The tool accessory product 10 has a tool accessory packaging 12 and at least one tool accessory 14, which is packed in the tool accessory packaging 12. Accordingly, the tool accessory 14 is designed as a drill bit. Alternatively, the tool accessory packaging 12 could be a packaging for a hammer accessory, a screw, a screwdriver accessory, a grinding tool accessory, a saw accessory or the like. FIG. 1 shows the tool accessory 14 arranged in a receiving pocket 18 of a packaging base body 16 of the tool accessory packaging 12. In particular, a packaging state is shown in FIG. 1. In the packaging state, at least the tool accessory 14 is arranged in the receiving pocket 18 of the tool accessory packaging 12.

Figure 3:
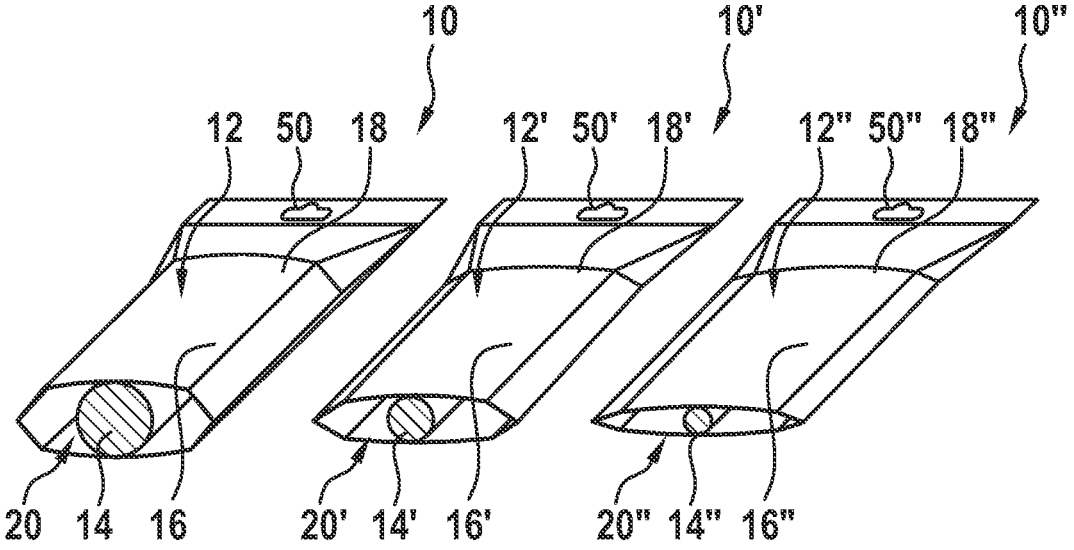

The receiving pocket 18 is a folded pocket for receiving the tool accessories 14. The packaging base body 16 is intended to receive tool accessories 14 with different geometries. In this case, the receiving pocket 18 adapts to a geometry of the tool accessory 14 at least in sections due to its material-specific restoring force when the tool accessory 14 is arranged in the receiving pocket 18 and fixes the tool accessory 14 in a receiving region 20 of the receiving pocket 18. In the present case, the tool accessory 14 is fixed in the receiving region 20 so that it cannot slip. In the present case, a pocket diameter of the receiving pocket 20 adapts to the geometry of the tool accessory 14, specifically to the diameter of the tool accessory 14. One and the same packaging base body 16 can receive tool accessories 14 with different geometries. To illustrate this, FIG. 3 shows three tool accessory packs 12, 12', 12", which are identical to one another and each have their receiving pockets 18, 18', 18" adapted to different geometries of tool accessories 14, 14', 14". By means of the material-specific restoring force and the material-specific flexibility, the tool accessories 14, 14', 14" can be secured and/or fixed in the receiving regions 20, 20', 20" of the receiving pockets 18, 18', 18" in a non-slip manner.

Figure 2:
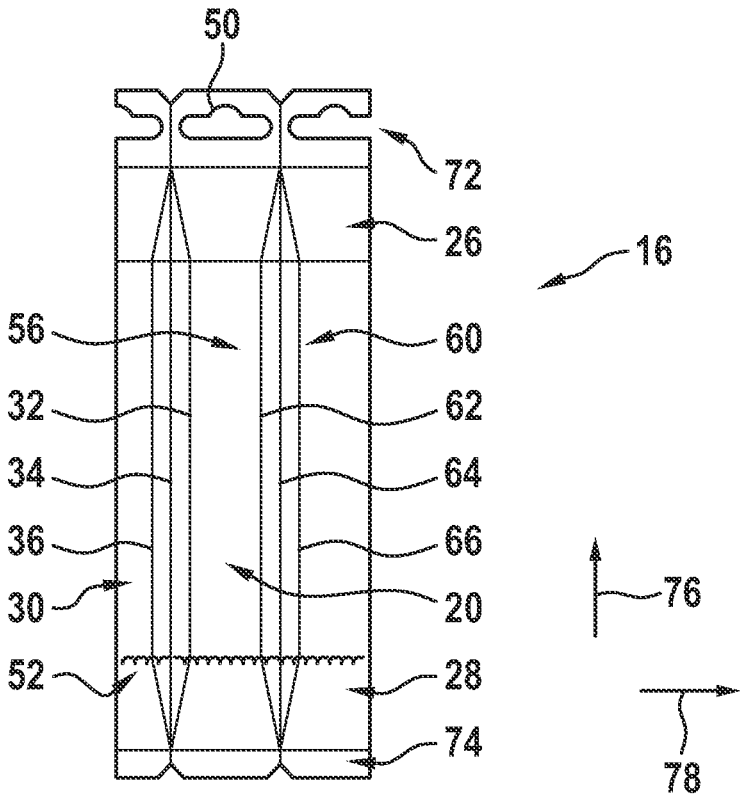

FIG. 2 shows the packaging base body 16 formed from a flat material/flat blank before shaping to form the receiving pocket 18. FIG. 2 shows an unbent and/or unfolded state of the packaging base body 16. In the present case, the packaging base body 16 is formed in one piece. In order to provide particularly sustainable packaging for tool accessories, the packaging base body 16 is made at least to a large extent from renewable raw materials. Furthermore, at least a large part of the packaging base body 16 is made of a fiber-based material. In this exemplary embodiment, at least a large part of the packaging base 16 is made of paper, namely cardboard. In the present case, the packaging base 16 is made entirely of cardboard with a grammage of at least 300 g/m$^2$. It is also conceivable that the packaging base 16 has at least one visible material in at least one viewing region. The viewing region may be intended to allow an observer to at least partially view the tool accessory packaging 12 and/or at least one tool accessory 14 contained therein. The visible material can be, for example, an at least partially transparent film and/or transparent plastic and/or glass and/or the like.

In the present case, the packaging base body 16 is formed from a sealable material and has a sealing lacquer in at least one region 72, 74, namely a head end region 72 and a base end region 74. In the packaging state, the packaging base 16 is sealed at its opposite end regions 72, 74, namely in the head end region 72 and the base end region 74.

For simplified and convenient folding and/or bending, namely in order to be able to form the receiving pocket 18, the tool accessory packaging 12 has at least one group 30 of fold lines 32, 34, 36 comprising at least two, in the present case at least three, fold lines 32, 34, 36. The fold lines 32, 34, 36 of the group 30 of fold lines 32, 34, 36 run at least in sections at least essentially parallel to one another. In this exemplary embodiment, the fold lines 32, 34, 36 run straight to each other, at least in sections. All fold lines 32, 34, 36 of the group 30 of fold lines 32, 34, 36 run at least in sections at least essentially parallel to one another. In a flat state, namely an unbent and/or unfolded state of the packaging base body 16 according to FIG. 2, the fold lines 32, 34, 36 of the group 30 of fold lines 32, 34, 36 run at least essentially parallel to a longitudinal edge of the packaging base body 16. In a folded and/or bent state of the packaging base body 16 according to FIG. 1, at least one fold line 34 of the group 30 of fold lines 32, 34, 36 forms an outer longitudinal edge of the packaging base body 16.

The fold lines 32, 34, 36 of the group 30 of fold lines 32, 34, 36 run parallel to one another in at least one central region 56 of the packaging base body 16. The central region 56 is located between an upper region 26 and a lower region 28 of the packaging base body 16. In the main direction of extension of the packaging base body 16, namely viewed in the longitudinal direction 76 of the packaging base body 16, the central region 56 extends over at least 50% of an overall extension of the packaging base body 16. Viewed in the longitudinal direction 76 of the packaging base body 16, the lower region 28 extends in the present case over at least 15% of the overall extension of the packaging base body 16. Furthermore, viewed in the longitudinal direction 76, the upper region 26 extends over at least 15% of the overall extension of the packaging base body 16. In the present case, the upper region 26 and the lower region 28 extend in equal parts along the longitudinal direction 76 of the packaging base body 16.

In the present case, two adjacent/arranged fold lines 32, 34, 36 of the group 30 of fold lines 32, 34, 36 always have an at least essentially identical spacing from one another. A first distance between a first fold line 32 of the group 30 of fold lines 32, 34, 36 and at least a second fold line 34 of the group 30 of fold lines 32, 34, 36 is at least essentially identical to a second distance between the second fold line 34 and at least a third fold line 36 of the group 30 of fold lines 32, 34, 36, namely in the range of standardized tolerances (cf. FIG. 2).

FIGS. 1 through 3 illustrate that the tool accessory packaging 12 has at least one further group 60 of further fold lines 62, 64, 66 comprising at least two, in the present case at least three, further fold lines 62, 64, 66. The further fold lines 62, 64, 66 of the group 60 of further fold lines 62, 64, 66 extend at least in sections at least essentially parallel to each other and at least in sections at least essentially parallel to the fold lines 32, 34, 36 of the group 30 of fold lines 32, 34, 36. The further fold lines 62, 64, 66 of the group 60 of further fold lines 62, 64, 66 run parallel to one another in at least the central region 56 of the packaging base body 16. In at least the central region 56, the fold lines 32, 34, 36 of the group 30 of fold lines 32, 34, 36 run parallel to the further fold lines 62, 64, 66 of the group 60 of further fold lines 62, 64, 66. In the folded and/or bent state of the packaging base body 16, at least one further fold line 64 of the further group 60 of further fold lines 62, 64, 66 forms a further outer longitudinal edge of the packaging base body 16. According to FIG. 1, the outer longitudinal edge of the packaging base body 16 in the folded and/or bent state of the packaging base body 16 runs at least in sections at least essentially parallel to the further outer longitudinal edge (see FIG. 1).

In this exemplary embodiment, two adjacent/arranged further fold lines 62, 64, 66 of the further group 60 of further fold lines 62, 64, 66 always have an at least essentially identical spacing from one another. A first further distance between a first further fold line 62 of the further group 60 of further fold lines 62, 64, 66 and at least a second further fold line 64 of the further group 60 of further fold lines 62, 64, 66 is at least essentially identical to a second further distance between the second further fold line 64 and at least a third further fold line 66 of the further group 60 of further fold lines 62, 64, 66, namely in the range of standardized tolerances (cf. FIG. 2).

In this exemplary embodiment, the receiving region 20 extends between the group 30 of fold lines 32, 34, 36 and at least the further group 60 of further fold lines 62, 64, 66. In the packaging state shown in FIGS. 1 and 3, the tool accessory 14 is fixed at least essentially centrally in the receiving space 20 between the group 30 of fold lines 32, 34, 36 and the further group 60 of further fold lines 62, 64, 66. The receiving region 20 extends from the lower region 28 via the central region 56 to the upper region 26. At least a part and/or a section of the tool accessory 14 could be arranged in the upper region 26 and/or the lower region 28.

In order to optimize a fixation of the tool accessory 14 in the receiving region 20, at least the fold lines 32, 34, 36 of the group 30 of fold lines 32, 34, 36 converge to a point in at least one region of the packaging base body 16 different from an end region of the packaging base body 16. In this exemplary embodiment, the fold lines 32, 34, 36 of the group 30 of fold lines 32, 34, 36 converge to a point in the upper region 26 and the lower region 28. The respective ends of the fold lines 32, 34, 36 of the group 30 of fold lines 32, 34, 36 meet at a common point in the upper region 26 and the lower region 28 and converge there (see FIG. 2). Furthermore, the further fold lines 62, 64, 66 of the further group 60 of further fold lines 62, 64, 66 converge at a point in at least one region of the packaging base body 16 that is different from the end region. The further fold lines 62, 64, 66 of the further group 60 of further fold lines 62, 64, 66 converge to a point in the upper region 26 and the lower region 28. According to FIG. 2, the upper region 26 and the lower region 28 each have an additional fold line. The fold lines 32, 34, 36 of the group 30 of fold lines 32, 34, 36 and the further fold lines 62, 64, 66 of the further group 60 of further fold lines 62, 64, 66 converge at an angle to the additional fold line in the upper region 26 and the lower region 28.

To release the tool accessory 14, the packaging base body 16 has at least one perforated region 52. At least one perforation line is arranged in the perforation region 52. The aforementioned additional fold line in the lower region 28 is the perforation line. To remove and/or remove the tool accessory 14 from the receiving pocket 20, a user can tear open the packaging base body 16 at the perforation line in the lower region 28, at least in sections or completely. In a removal state for releasing the tool accessory 14, at least the lower region 28 is separated at least in sections from the central region 56. In the present case, the perforated region 52 is an intermediate region, namely a separating region between the central region 56 and the lower region 28. When removing and/or removing the tool accessory 14 from the receiving pocket 18, at least one side of the receiving pocket 18 is open at least in sections. In the present case, at least one bottom side of the receiving pocket 18 is open at least in sections in the removal state in order to remove the tool accessory 14 from the receiving pocket 18.

Furthermore, the tool accessory packaging 12 has a retaining element 50 in the head end region 72 for suspension and/or attachment to external elements and/or units. In this exemplary embodiment, the retaining element 50 is a Eurohole known to the person skilled in the art. In the head end region 72, a Eurohole is punched into the packaging base body 14 (see FIGS. 1 and 2).

The invention claimed is:

1. A tool accessory packaging for at least one tool accessory, comprising:

a packaging base body which forms a receiving pocket configured to receive the at least one tool accessory, the receiving pocket being configured to accommodate tools having different geometries, wherein the receiving pocket adapts to a geometry of the at least one tool accessory, at least in sections, due to a material-specific restoring force of the receiving pocket when the at least one tool accessory is arranged in the receiving pocket such that the receiving pocket fixes the at least one tool accessory in a receiving region, wherein the packaging base body comprises:

at least one perforated region configured for releasing the at least one tool accessory, the at least one perforated region including a perforation line extending completely across the packaging base body so as to enable the packaging base body to be completely separated along the perforation line;

at least one group of fold lines comprising at least two fold lines, which, at least in sections, run at least essentially parallel to one another; and at least one further group of further fold lines comprising at least two further fold lines which extend at least in sections at least essentially parallel to one another and at least in sections at least essentially parallel to the at least two fold lines of the at least one group of fold lines; and a head end region, wherein the receiving region extends between the at least one group of fold lines and the at least one further group of further fold lines and the packaging base body is configured to receive and fix the at least one tool accessory at least essentially centrally in the receiving region between the at least one group of fold lines and the at least one further group of further fold lines, wherein the at least two fold lines of the at least one group of fold lines converge to a point in an upper region of the packaging base body, and wherein the head end region extends from the point in a direction away from the receiving region.

2. The tool accessory packaging according to claim 1, wherein the packaging base body is formed from a sealable material and has a sealing lacquer in at least the head end region.

3. The tool accessory packaging according to claim 1, wherein the packaging base body is sealed in at least one packaging state at the head end region and an opposite base end region.

4. The tool accessory packaging according to claim 3, wherein:

at least two fold lines of the at least one group of fold lines converge to a second point in a lower region of the packaging base body, and the base end region adjoins the lower region at the second point.

5. The tool accessory packaging according to claim 1, wherein the packaging base body is formed in one piece.

6. The tool accessory packaging according to claim 5, wherein the packaging base body is formed from a flat blank.

7. The tool accessory packaging according to claim 1, wherein the packaging base body is formed at least to a large extent from renewable raw materials.

8. The tool accessory packaging according to claim 7, wherein the packaging base body is formed at least to a large extent from a fiber-based material.

9. A tool accessory product comprising:

the tool accessory packaging according to claim 1; and the at least one tool accessory packed in the receiving pocket of the tool accessory packaging.

10. The tool accessory product according to claim 9, wherein the tool accessory product is a drill bit product, and the at least one tool accessory is a drill bit.

11. The tool accessory packaging according to claim 1, wherein the receiving pocket fixes the at least one tool accessory in the receiving region in a non-slip manner.

12. The tool accessory packaging according to claim 1, wherein the receiving pocket is configured as a folding pocket.

13. The tool accessory packaging according to claim 1, wherein the at least one tool accessory is a drill bit.

14. The tool accessory packaging according to claim 1, wherein the at least two fold lines includes at least three fold lines and the at least two further fold lines includes at least three further fold lines.

15. The tool accessory packaging according to claim 1, wherein the perforation line is arranged at a separating region between a central region and a lower region of the packaging base body so as to enable the lower region to be completely separated from the central region along the perforation line.

16. The tool accessory packaging according to claim 1, wherein the head end region defines a retaining opening.

* * * * *